US007370565B2

(12) United States Patent
Pressley et al.

(10) Patent No.: US 7,370,565 B2
(45) Date of Patent: May 13, 2008

(54) APPARATUS FOR MIXING EXPLOSIVE MATERIALS AND FOR FILLING OF ORDNANCE

(75) Inventors: Malcolm Pressley, Gwent (GB); Colin H. Bastow, Gwent (GB); Graham Hicks, Gwent (GB)

(73) Assignee: BAE SYSTEMS plc, London (GB)

( * ) Notice: Subject to any disclaimer, the term of this patent is extended or adjusted under 35 U.S.C. 154(b) by 84 days.

(21) Appl. No.: 10/507,171

(22) PCT Filed: Mar. 6, 2003

(86) PCT No.: PCT/GB03/00954

§ 371 (c)(1),
(2), (4) Date: Sep. 10, 2004

(87) PCT Pub. No.: WO03/078356

PCT Pub. Date: Sep. 25, 2003

(65) Prior Publication Data

US 2005/0188824 A1 Sep. 1, 2005

(30) Foreign Application Priority Data

Mar. 11, 2002 (GB) ..... 0205559.8

(51) Int. Cl.
*F42B 33/02* (2006.01)

(52) U.S. Cl. ..... 86/31; 86/23; 149/19.6

(58) Field of Classification Search ..... 86/31, 86/1.1; 149/109.6
See application file for complete search history.

(56) References Cited

U.S. PATENT DOCUMENTS 4,142,928 A * 3/1979 Stewart ..... 149/109.6
4,191,480 A 3/1980 Hiorth
4,199,262 A * 4/1980 Cribb et al. ..... 366/44
4,213,712 A * 7/1980 Aanonsen et al. ..... 366/168.2
4,246,489 A * 1/1981 Yoshida et al. ..... 250/577
4,369,689 A * 1/1983 Donaghue et al. ..... 86/20.15
4,405,534 A * 9/1983 Deisenroth ..... 264/3.4
4,491,489 A 1/1985 Ellis et al.
4,503,994 A * 3/1985 Pyle ..... 222/64
4,511,412 A 4/1985 Kakino et al.
4,663,473 A * 5/1987 Geigel et al. ..... 560/336
4,905,743 A * 3/1990 Gray ..... 141/198
4,966,077 A * 10/1990 Halliday et al. ..... 102/313
5,007,973 A 4/1991 Trapp et al.
5,059,261 A * 10/1991 Condo et al. ..... 149/19.92
5,074,937 A 12/1991 Stott et al.
5,114,630 A 5/1992 Newman et al.
5,137,366 A * 8/1992 Hill et al. ..... 366/47
5,453,250 A * 9/1995 Kreuer et al. ..... 422/133
6,179,458 B1 1/2001 Albers et al.
6,397,719 B1 * 6/2002 Vestre ..... 86/20.15

(Continued)

FOREIGN PATENT DOCUMENTS

CA 2 418 319 A1 8/2003

(Continued)

*Primary Examiner*—Michael J. Carone
*Assistant Examiner*—Stewart T Knox
(74) *Attorney, Agent, or Firm*—Crowell & Moring LLP

(57) ABSTRACT

Described herein is apparatus for the mixing of explosive materials utilising a static mixer (26) for combining pre-mix explosive material and hardener prior to introducing the combined mixture into any ordnance (38).

10 Claims, 1 Drawing Sheet

U.S. PATENT DOCUMENTS

| | | | | |
|---|---|---|---|---|
| 6,899,453 | B2 * | 5/2005 | Koch et al. | 366/174.1 |
| 6,919,390 | B2 | 7/2005 | Augier et al. | |
| 2005/0183611 | A1 * | 8/2005 | White et al. | 102/282 |

FOREIGN PATENT DOCUMENTS

| | | | |
|---|---|---|---|
| DE | 41 15 201 | A | 1/1992 |
| FR | 2 225 979 | A | 11/1974 |
| GB | 2 126 910 | A | 6/1983 |
| GB | 1 605 257 | A | 9/1986 |
| GB | 2 205 386 | A | 5/1988 |

* cited by examiner

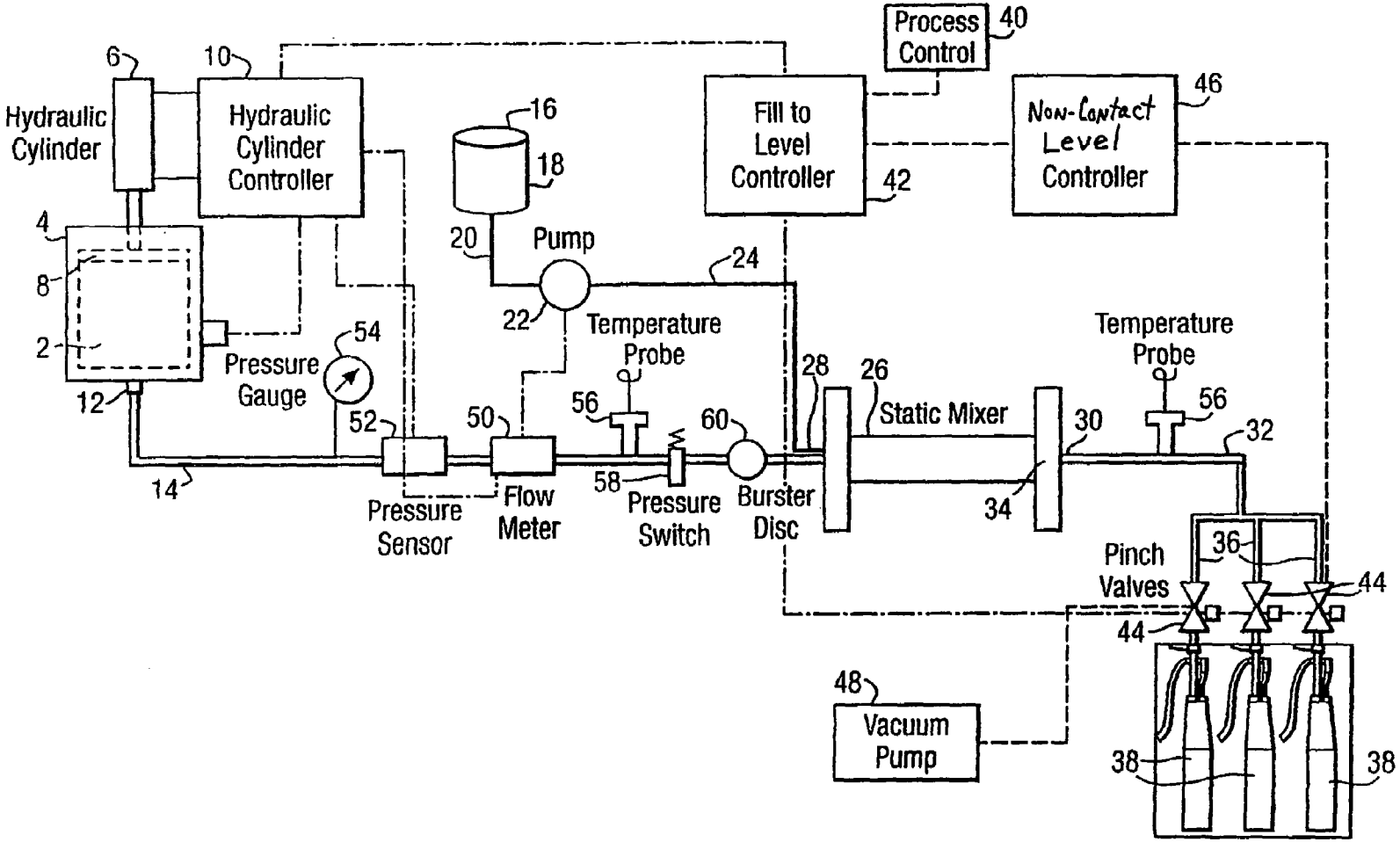
Hydraulic Cylinder
Hydraulic Cylinder Controller
Pressure Gauge
Pump
Fill to Level Controller
Process Control
Non-Contact Level Controller
Temperature Probe
Temperature Probe
Static Mixer
Burster Disc
Pressure Switch
Flow Meter
Pressure Sensor
Pinch Valves
Vacuum Pump
2
4
6
8
10
12
14
16
18
20
22
24
26
28
30
32
34
36
38
38
40
42
44
44
46
48
50
52
54
56
56
58
60

APPARATUS FOR MIXING EXPLOSIVE MATERIALS AND FOR FILLING OF ORDNANCE

This invention relates to the field of the filling of ordnance with explosive materials, and more specifically to the use of static mixing in the filling process.

BACKGROUND OF THE INVENTION

Traditional methods used for filling ordnance with polymer bonded explosive (PBX) utilize a filling process based on the combination of usually two materials, namely an explosive mixture (pre-mix) and hardener, which are mixed together immediately prior to use in filling the chosen ordnance.

In a typical application of the mixing and filling process, a pre-mix of explosive such as, for example, PBX is produced and typically mixed with a hardener (i.e., IPDI), the combined mixture being mixed together in a high shear mixer.

Once mixed, the bowl of the high shear mixer containing the fully mixed PBX composition is fitted with a pressure plate apparatus and cover, then raised to an appropriate filling height on a specialized bowl lift.

Once elevated into position, the bowl of fully mixed PBX composition is pressurized using an inert gas (i.e., nitrogen) for the purposes of aiding the dispensing of the fully mixed PBX composition through a system of pipes to the ordnance filling position.

Ordnance to be filled is typically placed in a vacuum chamber and a filling attachment from the bottom outlet valve of the mixer bowl containing the fully mixed PBX composition is attached to the chamber. Typically, the vacuum will be evacuated to <100 millibars.

The vacuum provides the physical motivation for the fully mixed PBX composition to flow into the ordnance when the valve from the bottom outlet of the mixer bowl is released. The quantity of fully mixed PBX composition introduced to the cavity within the ordnance is usually judged visually, and when sufficiently filled, the vacuum to the chamber is released and the filled component removed ready for the introduction of the next ordnance component to be filled.

The traditional method of filling ordnance as described above suffers from a number of problems associated with the finite 'pot life' time of the fully mixed PBX composition and the fact that once the various chemicals have been combined, the 'pot life' time defines the period within which the filling process must be completed before the PBX composition cures and can no longer be used in the process (i.e., would solidify within the pipe work).

The 'pot life' is typically in the order of two hours and in instances where there are no problems associated with a particular batch of components, then the mixing of PBX and hardener (IPDI) in a bowl and the subsequent dispensing of the fully mixed PBX composition into ordnance can be achieved relatively quickly. However, if for any reason (for example, mechanical breakdown, etc.) the filling process has to be interrupted or indeed suspended, then the whole of the fully mixed PBX composition has to be purged from the mixing and filling apparatus, the purged material being lost to waste.

SUMMARY OF THE INVENTION

The invention described herein provides for apparatus and a method for the mixing of explosive compositions and the subsequent filling of ordnance without being subject to the problems associated with having to mix and use a specific quantity of explosive composition within a limited 'pot life' period.

Accordingly, there is provided apparatus for the mixing of explosive materials, comprising:

a reservoir of pre-mixed explosive material, a reservoir of hardener material, and a static mixer, wherein each of the reservoirs has piping for conveying the pre-mix explosive material and hardener material respectively into the inlet of a static mixer, whose outlet is connected to apparatus for effecting the filling of ordnance components.

Preferably the piping for conveying each of said materials are not linked or combined until they reach the inlet of said static mixer.

Preferably the apparatus for filling each of the ordnance components with the final mixed explosive material will be controlled such that the respective pre-mix explosive material and the hardener materials are introduced to the static mixer on demand, thereby minimizing the amount of combined explosive material in the apparatus to that contained in the static mixer itself and the associated pipe-work used to connect the output of said static mixer unit to the ordnance for filling.

Other objects, advantages and novel features of the present invention will become apparent from the following detailed description of the invention when considered in conjunction with the accompanying drawings.

BRIEF DESCRIPTION OF THE DRAWINGS

The single FIGURE is a diagrammatic representation of an explosive mixing and ordnance filling apparatus in accordance with the invention.

DETAILED DESCRIPTION OF THE INVENTION

Referring to the FIGURE, a pre-mix explosive material 2 is shown in a high shear mixing bowl assembly 4 in which the mixing of the pre-mix explosive material 2 has been completed. The pre-mix explosive material 2 within the mixing bowl assembly 4 is subjected to controlled pressure by the action of a hydraulic cylinder 6 and ram 8 assembly. A hydraulic cylinder controller 10 is provided for controlling the flow of pre-mix explosive material 2 through the exit valve 12 and onwards through the pre-mix explosive material pipe work 14.

Hardener material 16 is depicted housed within a header tank 18 having pipe work 20 leading to a pump 22 to provide the controlled supply of hardener material 16 through the pipe work 24.

A static mixer 26 is provided having pipe work 14 and 24 at its inlet port 28 and an outlet port 30 and corresponding pipe work 32 for conveying final mixed explosive material 34 to ordnance filling stations 36.

In use, ordnance 38 to be filled with final mixed explosive composition 34 are positioned at ordnance filling stations 36. When the ordnance is correctly in position 38 and the associated fill-to-level controller 42 is connected, a signal from the process control 40 to initiate the filling operation is activated. A demand signal is received by the fill-to-level controller 42 from a non-contact level controller 46 indicating that the ordnance is not filled and accordingly the fill-to-level controller 42 sends a demand signal to the pre-mix explosive material hydraulic cylinder controller 10 and the hardener material pump 22.

The pre-mix explosive material 2 and hardener material 16 are conveyed through their respective separate pipe works 14, 24, and are introduced individually to the inlet 28 of the static mixer 26. It is important to note at this point that in accordance with the invention, the point at which the pre-mix explosive material 2 and hardener material 16 are first combined is substantially at the inlet port 28 of the static mixer means 26 thereby providing a distinguishing feature over the prior art in which the two materials are normally combined in the mixing bowl, thereby starting the 'pot life' for the combined explosive material within the mixing bowl 4.

At the inlet 28 of the static mixer 26 the pre-mix explosive material 2 and hardener material 16 are forced through a number of static mixing blades (not shown), thereby mixing the two materials 2, 16 together. Such static mixing blades are known within the confectionery and food industries and typically comprise a plurality of blades arranged in a 'corkscrew' manner, which promotes the effective mixing together of two or more materials when forced through the mixer.

Additionally, the use of a static mixer provides for simplified cleaning of the apparatus following the completion of an ordnance filling run, thereby further reducing the inherent complexity and time required for purging and cleaning using state of the art apparatus.

The combined final explosive mixture 34 passes through the static mixer exit port 30 and along the pipe-work 32 arriving at the ordnance filling stations 36. There, the flow of combined explosive mixture 34 into the waiting ordnance 38 is controlled via pinch valves 44, whose operation is controlled so as to limit the volume of combined final explosive mixture 34 introduced into the ordnance 38. A vacuum source 48 is provided to encourage the filling of the volume within the ordnance.

The control of the valves 44 (typically pinch valves) to enable the accurate filling of the ordnance may be effected either by a human operator directly controlling a valve 44 or by a mechanized system, which for the purposes of this specific embodiment utilizes a non-contact level controller 46 which forms part of an integrated control system 10, 40, 42, 46, 48.

When the non-contact level controller 46 senses that ordnance 38 requires filling with combined final explosive mix 34, a signal is sent to the fill-to-level controller 42 which in turn initiates the flow of both pre-mix explosive material 2 and hardener material 16 through the static mixer 26 and via the outlet pipe work into the waiting ordnance 38. When the non-contact level controller 46 senses that any of the ordnance 38 has reached its fill limit, then a signal is sent to the fill-to-level controller 42 to stop the flow of materials 2 and 16.

The non-contact level controller 46 may comprise, for example, an optical sensor, a fibre optic sensor, a laser sensor or an LED sensor.

Using the above stated control system provides for both apparatus and a method of filling ordnance 38 with combined final explosive mixture 34 in a controlled manner, utilizing apparatus that prolongs the 'pot life' of the combined final explosive material 34. This technique significantly reduces waste explosive material to be disposed of, and additionally simplifies the cleaning of the system by minimizing the number of elements of the apparatus actually exposed to combined final explosive material 34. The method of filling ordnance 38 using such apparatus and controllers can provide an automated ordnance filling system.

In order to clean the apparatus as described, the action of pumping pre-mix explosive material 2 (or an alternative compatible inert material) through the apparatus in the absence of any hardener material 16 will be substantially sufficient to purge the system of any combined final explosive material 34, thereby reducing the complexity, time and danger level associated with purging state of the art apparatus within which combined final explosive material has been allowed to cure.

In addition to the elements described above, a number of measuring sensors and safety devices would also be incorporated into the apparatus as shown in the FIGURE, namely a flow meter sensor 50, a pressure sensor 52, temperature probes 56, a pressure switch 58 and a safety burst disc 60. Such sensors and safety devices are known in the art and are included in the specific embodiment by way of example to illustrate the industrial application of the invention.

Additionally, a color agent or dye can be added to the hardener material 16 such that it will be possible to monitor the amount of hardener 16 present in the final combined explosive mixture 34. The analysis of the color of the combined mixture 34 may be made by utilizing a color sensor means located after the mixing process, calibrated to recognize particular ranges of color as indicating sufficient percentage of hardener in the combined material 34, or by use of a viewing window in the pipe work containing the combined mixture 34 to allow for visual inspection of the color of the mixture 34.

It is to be noted that the hydraulic cylinder 6 and ram 8 assembly is far safer than using displacement pumps to pump the pre-mix explosive material to the static mixer 26. It is also to be noted that the pre-mix explosive material is not pumped to the static mixer as this may be too dangerous.

As an alternative, instead of being located in the pre-mix explosive material pipe work 14, the flow meter may be located in the hydraulic line to the hydraulic ram 8. In this case, the flow meter accurately measures the displacement of the ram 8 and hence the mass flow of the pre-mix explosive mixture. This alternative is of particular use when the pre-mix explosive material is too viscous and inaccurate flow readings are obtained when the flow meter is in the pre-mix explosive material pipe work 14.

Other advantages of the invention will be readily apparent to those skilled in the art and the substitution of elements for mechanical equivalents and adaptation of the process using different materials and the like should be construed as being comprised within in the inventive concept as claimed.

References to ordnance in the above specification and claims shall be construed as non-limiting and in respect of the invention shall include without limitation shells, mortars, rockets, projectiles and any other ordnance or containers which are required to be filled with a combined final explosive mixture.

The invention claimed is:

1. Apparatus for mixing explosive materials, comprising:

a first reservoir containing a pre-mix comprising an explosive material in flowable form;

a second reservoir of hardener material which, when combined with said pre-mix, causes it to solidify;

a static mixer;

separate piping associated with each of said reservoirs for conveying said pre-mix and said hardener material, respectively, to the static mixer for mixing; and a hydraulic cylinder and ram assembly coupled to apply controlled pressure to the pre-mix within said first reservoir, for controlling a flow of said pre-mix towards said static mixer.

2. Apparatus for mixing explosive materials in accordance with claim 1, wherein said materials are combined substantially at an inlet of said static mixer.

3. Apparatus for mixing explosive materials in accordance with claim 1, wherein an outlet of said static mixer is connected to piping for filling ordnance with a combined final explosive material comprising a mixture of said pre-mix and said hardener material.

4. Apparatus for mixing explosive materials in accordance with claim 3 wherein the piping for filling ordnance with combined final explosive material is controlled such that the respective pre-mix and hardener materials are introduced to the static mixer on demand, the demand being controlled by an automated ordnance fill level controller.

5. Apparatus for mixing explosive materials in accordance with claim 4 wherein said automated ordnance fill level controller comprises at least one fiber optic sensor.

6. Apparatus for mixing explosive materials in accordance with claim 1, wherein said explosive material comprises PBX.

7. The apparatus according to claim 1, further comprising:

a flow meter for measuring a flow of hydraulic fluid in said hydraulic cylinder and ram assembly for determining said flow of said pre-mix.

8. The apparatus according to claim 1, further comprising:

a level controller for sensing whether ordnance requires filling, and for generating a corresponding signal; and a fill to level controller for initiating the flow of said pre-mix in response to said signal.

9. A method for mixing explosive materials comprising:

holding in a first reservoir a pre-mix comprising an explosive material in flowable form;

holding in a second reservoir a hardener material which when combined with said pre-mix, causes it to solidify;

conveying said pre-mix and said hardener material to a static mixer via separate pipes; and controlling a flow of pre-mix towards said static mixer by using a hydraulic cylinder and ram assembly to apply controlled pressure to the pre-mix within said first reservoir.

10. The method according to claim 9, further comprising:

sensing whether ordnance requires filling, and sending a signal indicative thereof; and initiating the flow of pre-mix explosive material in response to said signal.

* * * * *